United States Patent [19]

Lynch et al.

[11] Patent Number: 4,874,028

[45] Date of Patent: Oct. 17, 1989

[54] TEMPORARY DETACHABLE DOORWAY SCREEN APPARATUS

[76] Inventors: Carol J. Lynch; Debbie J. Corday, both of 18550 Hatteras St. #92, Tarzana, Calif. 91356

[21] Appl. No.: 190,887

[22] Filed: May 6, 1988

[51] Int. Cl.[4] ..... A47H 23/01

[52] U.S. Cl. ..... 160/332; 160/126

[58] Field of Search ..... 160/332, 330, 123, 126

[56] References Cited

U.S. PATENT DOCUMENTS

| | | | |
|---|---|---|---|
| 1,679,881 | 8/1928 | Simpson | 160/330 |
| 4,147,199 | 4/1979 | Cameron | 160/330 |
| 4,188,991 | 2/1980 | Boyle | 160/330 X |
| 4,249,589 | 2/1981 | Loeb | 160/354 X |
| 4,333,187 | 6/1982 | Schuler | 160/330 X |
| 4,436,137 | 3/1984 | Charles | 160/242 |
| 4,437,505 | 3/1984 | Rodgers | 160/126 |

*Primary Examiner*—Alvin C. Chin-Shue
*Assistant Examiner*—David M. Purol
*Attorney, Agent, or Firm*—Christie, Parker & Hale

[57] ABSTRACT

A temporary detachable doorway screen apparatus for a doorway in a dwelling comprises a flexible sheet of screening material shaped to cover the enclosed area within the open doorway. The flexible sheet is made from a flexible polymeric material which allows the entire screen to be rolled up or unrolled for use. The sheet of screen material is provided as a pair of side-by-side screen sections normally separated from one another and overlapping vertically along a central portion of the screen to form an opening along the overlapped portions of the screen sections. An elongated tension rod secured to the top portion of the screen is adjustable in length and applies spring pressure at its ends to the side of the door frame members for frictionally and releasably holding the tension rod above the doorway. This holds the flexible screen in position to cover the doorway. Spaced apart fastener elements are provided along the overlapping central opening in the screen sections and along the outer vertical marginal edges of the screen. The fasteners releasably attach the sides of the screen to the side members of the door frame to provide a non-marring means for easily fastening the flexible screen in a temporary fixed and closed position over the doorway. The fasteners also allow the central opening of the screen to be easily opened for passage through the screen. The entire screen can be easily detached in a non-marring fashion from the door frame for easy removal of the temporary screen.

7 Claims, 1 Drawing Sheet

TEMPORARY DETACHABLE DOORWAY SCREEN APPARATUS

FIELD OF THE INVENTION

This invention relates to a detachable doorway screen which can be temporarily secured to the frame of a doorway to protect the interior of a dwelling from insects and the like.

BACKGROUND OF THE INVENTION

Most apartments and condominiums are not allowed to have screen doors. During the warm seasons in particular, the occupants often will prefer to leave their doors open for outside air circulation. During hotter weather it is often desirable to open the doors to the outside so the cool evening breezes can cool off the inside of the dwelling, rather than continuing to run the air conditioner. However, annoying pests such as bugs and insects such as flies, mosquitoes or bees cannot be kept out of the condominium or apartment not having a screen door.

A principal objection to screen doors is that they tend to be unsightly and therefore detract from the appearance or aesthetic appeal of the property. Screen doors also become easily damaged or deteriorated during use and therefore further impair the appearance of the property.

Thus, there is a need to provide a means for allowing air circulation to the inside of dwellings through open doorways while preventing annoying pests from entering the dwelling.

The present invention provides a temporary detachable doorway screening apparatus which solves these problems.

SUMMARY OF THE INVENTION

Briefly, one embodiment of the invention comprises a flexible sheet of screening material shaped to cover the area within an open doorway of a dwelling. The flexible screen is made from a polymeric material in a form which allows the entire sheet of screening to be rolled up for storage or unrolled for use. The sheet of screening material is preferably formed as a pair of side-by-side screen sections separated and overlapping vertically to form an opening along the central portion of the flexible screen. The screen is carried on a tension rod adjustable in length and adapted to apply spring pressure at its ends for frictionally and releasably holding the tension rod to the door frame, above the doorway. This allows the attached screen to be easily positioned in removable fashion over the doorway in a non-marring arrangement. This also allows the screening apparatus to be adjusted to different sizes of doorways. The top of the flexible screen can be gathered along the tension rod to adjust the screen size to match different sizes of doorways. Releasable fastening means are attached to the overlapping portions of the screen along the vertical opening therein and separate releasable fastening means are attached to the outer side edges of the screen sections. This allows releasable closure of the vertical opening through the screen and releasable non-marring attachment of the side edges of the screen to the sides of the door frame, for removably holding the flexible screen in place during use.

The detachable doorway screen can be attached to the door frame without damaging the property. It can be easily removed, rolled up in a compact size and transported with the owner rather than remaining a fixture of the property. It is adjustable to fit various door sizes and is adaptable to provide easy access for sliding glass doors or other door configurations. It provides easy exit or entrance for children and pets. It is also completely waterproof and non-corrosive. It is not easily damaged and can be manufactured at a reasonably low production cost.

These and other advantages of the invention will be more fully understood by referring to the following detailed description and the accompanying drawings.

DRAWINGS

FIG. 1 a semi-schematic fragmentary elevation view illustrating a temporary detachable doorway screen apparatus according to principles of this invention.

DETAILED DESCRIPTION

Figure 1:
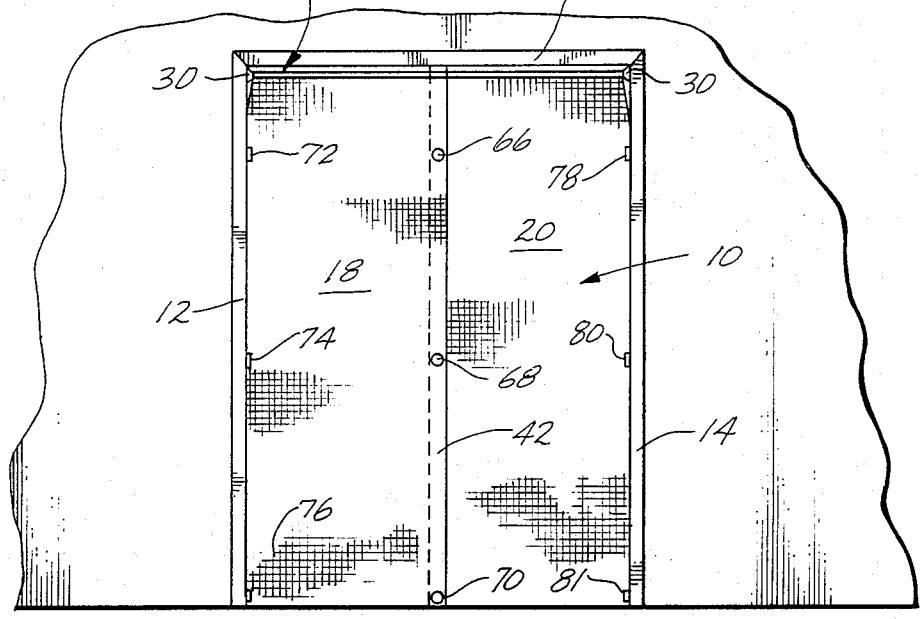

FIG. 1 is a semi-schematic elevation view illustrating a temporary detachable doorway screening apparatus 10, according to principles of this invention. The screen is positioned over the opening within a door frame having a left frame member 12, a right frame member 14, and a header 16 at the top of the doorway.

The screen apparatus includes a flexible mesh screening made from a polymeric material such as nylon or fiberglass netting so that the screen can be easily rolled up or unrolled. These materials also are resistant to corrosion and otherwise are unaffected by long term exposure to harsh weather or sunlight.

The plastic mesh screen preferably comprises a pair of side-by-side left and right screen sections 18 and 20, respectively. The screen sections are supported at the top by an elongated tension rod 22 releasably secured above the doorway between the left and right door frame members 12 and 14.

Figure 3:
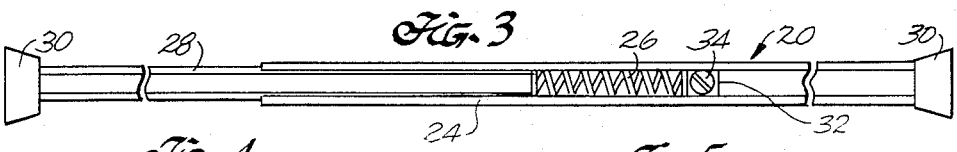
FIG. 3 is a fragmentary semi-schematic elevation view illustrating a means for adjusting the length of a tension rod holding a screen apparatus.

The tension rod can be any type of rigid screen support member capable of being releasably secured by friction between the sides of the doorway. The tension rod thereby fastens to the doorway in a non-marring fashion. The tension rod also provides a means for quickly and easily securing the screen in position over the doorway and can be easily detached from its frictionally-held position over the doorway. Further, the tension rod can be easily adaptable by selective adjustment of its length for being releasably fastened to doorways of various sizes. FIG. 3 illustrates a preferred arrangement of the tension rod which comprises a telescoping and spring biased adjustable tension rod having a member 24 of fixed length containing an internal coil spring 26. A slide member 28 telescopingly slides inside the fixed member 24, against the bias of the spring 26. The outer ends of the fixed member 24 and slide member 28 have resilient feet 30 with flat end surfaces for bearing against the sides of the door frame members by the pressure of the spring 26. A slide fastener 32 slidably disposed inside a track within the fixed member 24 provides an adjustable stop for the spring 26. An adjustment screw 34 in the slide fastener can be released for movement axially and tightened to set the desired length of the telescoping tension rod.

Figure 2:
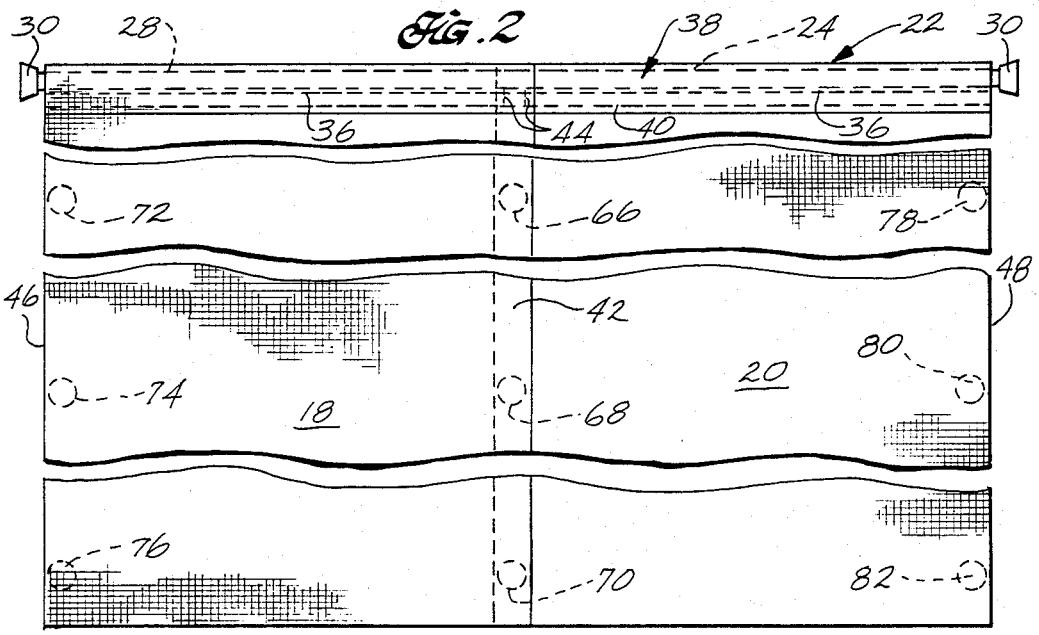
FIG. 2 is a fragmentary enlarged semi-schematic elevation view illustrating components of the screen apparatus.

As shown best in FIG. 2, the top of the screen is slidably supported on the tension rod. Preferably, the tops of the screen sections 18 and 20 are secured to each other as a unit by folding over the top portions of the screen sections and fastening them together by a row of stitching 36. This forms an elongated horizontally extending tunnel 38 across the top of the fastened screen sections. A second row of stitching 40 near the bottom of the overlapped upper portion of the screen sections further fastens the screen sections at the top of the screen. Further attachment of the upper portions of the screen sections is provided by box stitching 44 at the overlapping regions near of the top of the screen. The stitching 44 does not interfere with clear passage through the tunnel 38. The screen sections 18 and 20 are preferably overlapped along a long vertical opening 42 formed along a central portion of the overlapping screen sections. The overlap of the screen sections where the two screen sections are fastened to one another is preferably about one and one half inches wide, although this width can vary as desired. When the screen is held in place over the doorway, the inner edges of the screen sections form a continuous and uniform overlap along the central opening 42.

Preferably, the left and right side edges 46 and 48 of the screen sections are unsupported by any rigidizing members so that the side edges as well as the entire screen combination can be entirely flexible to allow the screen to be rolled up into a compact configuration or unrolled prior to mounting it over a doorway. Alternatively, a narrow flexible border (not shown) can be used along the vertical side edges and bottom of the screen section, if desired, in order to reinforce the edges of the screen. However, in such instances the resulting screen should maintain a high degree of flexibility so as to not inhibit its ability to be easily rolled up into a compact size and unrolled for use.

In using the detachable screen combination the tension rod 20 initially slides into the tunnel 38 at the top of the screen so that the screen can be supported by the tension rod. The screen is otherwise unsupported over the doorway. The tension rod is then adjusted in length to match the width of the doorway. The screen sections can be provided in a form which can be varied somewhat in width to match different sizes of doorways. That is, the flexible screen sections, even though attached together at the top, can be oversized a slight amount and gathered inwardly along the length of the tension rod, as desired, to conform to the set length of the tension rod. The tension rod is preferably set at a length slightly longer than the width of the doorway so that the rod can be held tightly in tension between the side frame members 12 and 14 by the spring 26.

Figure 4:
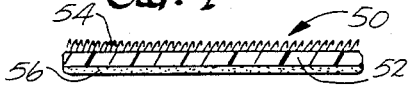
FIGS. 4 and 5 are schematic cross-sectional views illustrating cooperating fastening means used for attaching the screen apparatus in place over the doorway.

The detachable screen combination also includes a plurality of vertically spaced apart hook and loop fastening elements adhered to various vertically spaced apart locations on the screen sections. The preferred hook and loop fasteners are the well known fasteners preferably of the cloth tape variety sold under the trademark Velcro. These fasteners can be used, in part, in the form illustrated in FIGS. 4 and 5, which shows a velcro hook fastener 50 with a cloth backing 52, Velcro hooks 54 on its upper surface and a layer of adhesive 56 on the reverse surface. Similarly, the Velcro loop fastener 58 comprises a cloth backing 60, a Velcro loop fastener 62 on one surface, and a layer of adhesive 64 on the reverse surface. These fastener elements are available in long strips and can be cut to desired lengths to form multiple fastener elements used in a manner described below.

A plurality of vertically spaced apart fastener elements 66, 68 and 70 are fastened to upper, intermediate and lower portions the overlapping section 42 of the screen sections. The hook and loop fastener elements are attached to the spaced apart locations along the overlapping margins of the screens so that the fasteners on one overlapping portion are aligned with cooperating fasteners attached to the other overlapping portion. Preferably, these fasteners are permanently affixed to the overlapping margins of the screen by stitching or the like. Thus, the fasteners along the center of the screen can be releasably fastened to easily close the center of the screen, or they can be easily unfastened to open the center of the screen to provide a passageway through the screen.

Vertically spaced apart hook and loop fastener elements 72, 74 and 76 also are permanently attached to spaced apart locations along the left margin of the left screen section, and similarly, vertically spaced apart hook and loop fastener elements 80, 82 and 84 are permanently attached to the right margin of the right screen section. Alternatively, the fastener elements along the left and right side margins of the screen sections may be adhered to the screen sections by the permanent adhesive backing on the hook and loop fastener elements shown in FIGS. 4 and 5. This provides the user with an optional means for placing fastener elements at any desired locations along the outside edges of the flexible screen.

Figure 5:
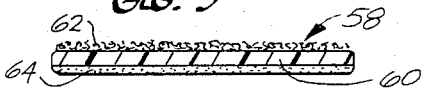

The hook and loop fasteners secured to the left and right side margins of the screen sections provide a means for releasably securing the screen sections to the adjacent door frames. Hook and loop fastener elements such as those shown in FIG. 5 are adhesively secured to the left and right door frame members in alignment with cooperating hook and loop fasteners on the left and right side margins of the screen sections. In one embodiment, the hook and loop fastener elements can be adhesively secured to the front face of the left and right door frame members, or they can be adhesively attached to the inside faces of the door frame members. In either instance the flexible screen sections can be of sufficient size so that the cooperating hook and loop fastener elements along their outer marginal edges can be easily frictionally attached to the corresponding hook and loop fasteners on the door frames while still allowing the combined screen sections to completely close off the doorway, including providing the continuous and essentially uniform overlap 42 along the center of the screen.

In one form of the invention, the temporary detachable doorway screen apparatus can be provided in a kit form which includes the tension rod, the composite screen provided by the attached screen sections, the attached hook and loop fastener elements, and adhesive-backed hook and loop fastener elements to provide a selective means for attaching the edges of the screen to the door frame.

Thus, the present invention provides a convenient means for quickly and easily closing off a doorway to prevent entrance of annoying pests while allowing a reasonable amount of air flow through the screen. The screen is made from a material which allows the entire screen to be easily rolled up and unrolled, and the screen is carried on a tension rod which allows the screen to be mounted over the doorway in a non-marring fashion. The screen section is easily adaptable to covering doorways of various sizes and allows for easily closing off or opening the temporary screen closure.

What is claimed is:

1. Temporary detachable doorway screening apparatus for a doorway defined by a door frame having a top frame member spaced above a floor and vertical side members extending from the floor to the top frame member, thereby forming an enclosed area within an open doorway of a dwelling, the apparatus comprising:

a flexible sheet of screening material shaped to cover substantially the entire enclosed area within said open doorway, the flexible sheet being made from a flexible polymeric mesh for allowing passage of light and air while preventing annoying pests from entering through the doorway and having upper, lower and vertical margins which also enhance flexibility so the entire sheet of screening material can be rolled up or unrolled for positioning it to cover the enclosed are within the doorway, the sheet of screening material being provided as a pair of side-by-side screen sections normally separated from one another and overlapping vertically along a central portion of the screen to form an opening along the overlapped portions of the screen sections, an elongated tension rod adjustable in length to apply spring pressure at its ends to the side frame members of the door frame for frictionally and releasably holding the tension rod above the door opening, means for securing the tension rod to a top portion of the screen, means providing vertically spaced apart fastener elements along the overlapping center portion of the screen for releasably opening or closing the screen from the floor continuously upwardly for most of the height of the screen; and means providing vertically spaced apart fastener elements along the vertical outer margins of the screen sections for releasable attachment to cooperating vertically spaced apart fastener elements releasably secured in a non-marring fashion to the side frame members of the door frame.

2. Apparatus according to claim 1 in which the fastener elements comprise hook and loop fasteners which are adhesively backed for non-marring attachment to the door frame members.

3. Apparatus according to claim 1 in which the screen sections are permanently fastened together as a unit at the top and form an elongated tunnel to slidably receive the tension rod.

4. Apparatus according to claim 1 in which the fastener elements along the overlapping central portion of the screen are permanently affixed to the screen.

5. Apparatus according to claim 1 in which the vertical marginal side edges of the flexible screen are unreinforced to provide flexibility substantially the same as that of the remaining screen section.

6. A kit for providing a temporary detachable doorway screening apparatus for a doorway defined by a door frame having a top frame member spaced above a floor and vertical side frame members extending from the floor to the top frame member, thereby forming an enclosed area within an open doorway of a dwelling, the kit comprising:

a flexible sheet of screening material shaped to cover substantially the entire enclosed area within said open doorway, the flexible sheet being made from a flexible polymeric mesh for allowing passage of light and air while preventing annoying pests from entering through the doorway and having upper, lower and vertical margins which also enhance flexibility so the entire sheet of screening material can be rolled up or unrolled for positioning it to cover the enclosed area within the doorway;

the sheet of screening material being provided as a pair of side-by-side screen sections normally separated from one another and overlapping vertically along a central portion of the screen to form an opening along the overlapped portions of the screen sections from the floor continuously upwardly for most of the height of the screen, an elongated tension rod adjustable in length to apply spring pressure at its ends to the side frame members of the door frame for frictionally and releasably holding the tension rod above the door opening, means for securing the tension rod to the top portion of the flexible screen, means providing vertically spaced apart fastener elements along the overlapping central portion of the screen for releasably opening or closing the screen, means providing vertically spaced apart fastener elements along the vertical marginal side edges of the screen sections for use in releasably attaching the outer marginal edges of the screen sections to cooperating fastener elements on the door frame; and adhesive-backed hook and loop fastener elements for adhesive non-marring attachment to the side and frame members of the door frame to cooperate with the fastener elements along the marginal side edges of the screen sections for use in releasably attaching the edges of the screen sections to the door frame.

7. A kit for providing a temporary detachable doorway screening apparatus for a doorway defined by a door frame having a top frame member spaced above a floor and vertical side frame members extending from the floor to the top frame member, thereby forming an enclosed area within an open doorway of a dwelling, the kit comprising:

a flexible sheet of screening material shaped to cover substantially the entire enclosed area within said open doorway, the flexible sheet being made from a flexible polymeric mesh for allowing passage of light and air while preventing annoying pests from entering through the doorway and having upper, lower and vertical margins which also enhance the flexibility so the entire sheet of screening material can be rolled up or unrolled for positioning it to cover the enclosed area within the doorway;

an elongated tension rod adjustable in length to apply spring pressure at its ends to the side frame members of the door frame for frictionally and releasably holding the tension rod above the door opening;

means for securing the tension rod to the top portion of the flexible screen;

means providing vertically spaced-apart fastener elements along the vertical marginal side edges of the screen for use in releasably attaching the outer marginal edges of the screen to cooperating fastener elements on the door frame; and adhesive-backed fastener elements for adhesive non-marring attachment to the side frame members of the door frame to cooperate with the fastener elements along the marginal side edges of the screen for use in releasably attaching the edges of the screen to the door frame.

* * * * *